United States Patent [19]

O'Loughlin

[11] 4,158,302

[45] Jun. 19, 1979

[54] TOOL WITH FULL-STROKE COMPELLING MECHANISM

[75] Inventor: Francis A. O'Loughlin, Scotch Plains, N.J.

[73] Assignee: Thomas & Betts Corporation, Elizabeth, N.J.

[21] Appl. No.: 863,686

[22] Filed: Dec. 23, 1977

[51] Int. Cl.[2] ..... B21D 7/06

[52] U.S. Cl. ..... 72/409; 29/221; 81/313

[58] Field of Search ..... 72/409, 410; 81/313; 29/221

[56] References Cited

U.S. PATENT DOCUMENTS

| | | | |
|---|---|---|---|
| 2,618,993 | 11/1952 | Carlson | 81/313 |
| 2,737,071 | 3/1956 | Dibner | 81/313 |
| 2,777,345 | 1/1957 | Reider | 81/313 |
| 2,842,018 | 7/1958 | Hammell | 81/313 |
| 2,959,993 | 11/1969 | Freimark | 81/313 |
| 3,039,337 | 6/1962 | Stuart-Prince | 81/313 |
| 3,230,758 | 1/1966 | Klingler | 72/410 |

*Primary Examiner*—C. W. Lanham
*Assistant Examiner*—Gene P. Crosby
*Attorney, Agent, or Firm*—David Teschner; Jesse Woldman

[57] ABSTRACT

A selectively positionable pivot coupling is provided between a full stroke compelling mechanism and either one or both of the tool handle members between which such mechanism is coupled to permit a re-opening of the handle members at preselected points in the closure stroke of the tool.

10 Claims, 11 Drawing Figures

TOOL WITH FULL-STROKE COMPELLING MECHANISM

BACKGROUND OF THE INVENTION

1. Field of the Invention

The invention is directed to the field of tools employing full stroke compelling mechanisms.

2. Description of the Prior Art

Various forms of linearly operable full stroke compelling mechanisms are well known in the prior art and are exemplified in U.S. Pat. No. 2,618,993 issued Nov. 25, 1952 to V. E. Carlson; U.S. Pat. No. 2,959,993 issued Nov. 15, 1960 to L. Freimark; and U.S. Pat. No. 3,039,337 issued June 19, 1962 to R. G. Stuart-Prince. Further examples of such mechanisms are also disclosed in U.S. Pat. Nos. 2,737,070 and 2,737,071 issued Mar. 6, 1956 to D. Dibner. Dibner discloses a mechanism which differs slightly from the other prior art devices by providing a factory adjustment of the full stroke compelling mechanism in relationship to the position of the handles of the tool to allow for manufacturing tolerances. In each case, however, the tool is designed for a single closure point generally at the point where the jaw members of the tool are in a fully closed position. Since the pivot points coupling the full stroke compelling mechanism to the respective handles of the tool are fixed, no adjustment is possible for releasing the full stroke compelling mechanism at any point other than full closure of the tool jaws. In many cases, the tool jaws are employed as a crimping device in which die recesses are provided for crimping a particular connector or fitting onto a single conductor or range of conductors. The release of the full stroke compelling mechanism is generally accomplished at full closure of the jaw members or, when the dies have been brought into abutting relationship. In many cases, however, it is desired to employ the same die configuration to install more than one size fitting in the same die, which would necessitate different release points in the full stroke compelling mechanism, which such prior art tools are unable to provide. It is therefore necessary either to change the die sets or to employ different tools for such applications.

SUMMARY OF THE INVENTION

The invention overcomes the difficulties and limitations noted above with respect to prior art devices by providing an economical, reliable and simple adjustable full stroke compelling mechanism to increase the versatility and usefulness of tools employing such mechanisms. In a preferred embodiment the adjustable feature may be incorporated in either or both handles of the tool to permit selective repositioning of the pivot coupling between the full stroke compelling mechanism and its associated handle member. Various embodiments are illustrated which include a movable pivot pin coupled to the ratchet member of the full stroke compelling mechanism and insertable in any one of a series of aligned pin receiving openings in an associated handle member of the tool. A similar arrangement may be provided at the other end of the full stroke compelling mechanism wherein the pivot coupling between the housing of the full stroke compelling mechanism and the other handle of the tool is selectively repositionable in any one of a number of aligned openings corresponding to a predetermined setting of the jaw members. Accordingly, by selectively repositioning the pivot coupling between the full stroke compelling mechanism and either one or both of the handle members of the tool the pawl release point at which the handles may be reversed and the jaw members opened may be controlled or adjusted so that the jaw members may be brought to selected closure points either corresponding to or somewhat less than full closure of the jaw members coincident with the pawl release point of the ratchet member. To prevent closure of the jaw members beyond the selected pawl release point there may be provided a stop means which, in one embodiment, comprises an abutment on the ratchet member engageable with the mechanism housing and fixedly spaced from the toothed end portion of the ratchet member to coordinate the pawl release point with the predetermined jaw member setting. It is therefore an object of this invention to provide an improved tool.

It is another object of this invention to increase the versatility of a tool having a full stroke compelling mechanism.

It is still another object of this invention to provide a simple and economical means for adjusting the jaw closure point in a tool having a full stroke compelling mechanism.

It is a further object of this invention to provide an adjustable full stroke compelling mechanism.

It is yet a further object of this invention to provide means in a pliers-like tool or the like for selectively repositioning the pivot coupling between its handle members and a full stroke compelling mechanism attached thereto.

Other objects and features of the invention will be pointed out in the following description and claims and illustrated in the accompanying drawings, which disclose, by way of example, the principle of the invention, and the best modes contemplated for carrying it out.

BRIEF DESCRIPTION OF THE DRAWINGS

In the Drawings.

Similar elements are given similar reference characters in each of the respective drawings.

DESCRIPTION OF THE PREFERRED EMBODIMENTS

Figure 3:
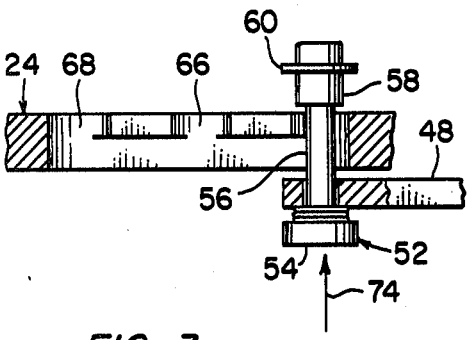
FIG. 3 is an enlarged fragmentary side elevational view, partly in section, showing further details of the device of FIG. 1.
Figure 4:
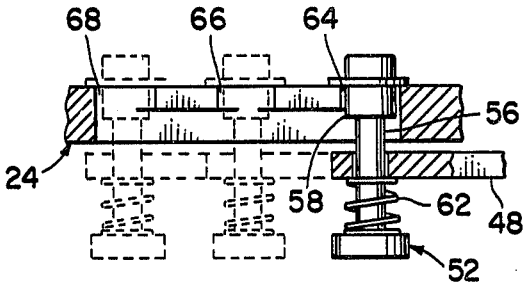
FIG. 4 is an enlarged fragmentary side elevational view, partly in section, showing additional details of the device of FIG. 1.
Figure 5:
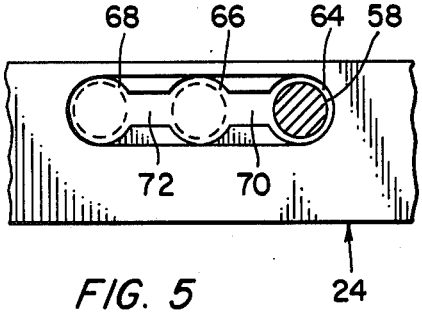
FIG. 5 is a fragmentary plan view, partly in section, of the assembly shown in FIG. 4.

Turning now to FIGS. 1 through 5 there is shown a pliers-like tool 20 constructed in accordance with the concepts of the invention and having a first handle member 22, and second handle member 24 joined together by a pivot pin 26 and terminating, respectively, in a first jaw member 28 and a second jaw member 30. Coupled between the handle member 22 and 24 is a full-stroke compelling mechanism including a housing 32 within which is pivotally coupled a pawl means 34 rotatable about a pivot pin 36 and springbiased in a counterclockwise direction, as viewed in FIG. 1, by a spring 38. The housing 32 is pivotally coupled to the distal end 40 of the handle member 22 by a pin 42 which extends transversely through the housing 32 and into a receiving aperture (not shown) in the handle member 22. The pawl means 34 is arranged to selectively engage a toothed end portion 44 of an elongate ratchet member 46 which is slidably disposed within the housing 32 and comprises an offset end portion 48 which is provided with a transverse aperture 50 (FIG. 2) dimensioned to slidably receive a releasable pivot pin 52. The pin 52 includes a head portion 54 from which extends a shank portion (FIG. 3) which, as shown in FIG. 3, comprises two segments 56 and 58 of different diameters for purposes which will be explained in greater detail hereafter. It will be noted that the segment 58 has a diameter somewhat larger than the segment 56 and is provided with a C-ring 60 to provide a stop therefore against the action of a biasing spring 62 (FIG. 4) tending to urge the pin 52 downwardly, as viewed in FIG. 4 so that, in its normal position, the pin 52 is disposed essentially as shown in FIG. 4 with the enlarged diameter segment 58 of the shank portion of the pin 52 seated within an opening 64 of a series of aligned openings 64, 66, and 68 (FIG. 5) extending along the longitudinal axis of the handle member 24. Interconnecting the openings 64, 66, and 68 are slotted portions 70 and 72 having a width slightly larger than the diameter of the shank segment 56 of the pin 52, whereas the openings 64, 66, and 68 are diametrically dimensioned to closely receive the shank segment 58 of the pin 52. Accordingly, by depressing the pin 52 in a direction shown by the arrow 74 in FIG. 3, the shank segment 58 is released from the particular one of the openings 64, 66, or 68 in which it is seated and may be repositioned in any other selected one of such openings by sliding the reduced diameter shank segment 56 through the slotted portions 70 and 72 until the pin 52 is located in the desired position. The pin 52 is then released and the shank segment 58 permitted to reseat in the selected one of the openings 64, 66, or 68. By readjusting the position of the pivot coupling between the ratchet member 46 and the handle member 24, the point at which the pawl means 34 enters a recess 76 (FIG. 1) at the inner end of the toothed end portion 44 of the ratchet member 46 relative to the position of the handle members 22 and 24 and, consequently, of the jaw members 28 and 30, may be selectively controlled or adjusted. Thus, as shown by the solid outline in FIG. 1, when the pivot pin 52 is seated in the opening 64 closest to the pin 42 which couples the housing 32 to the handle member 22, pawl release may be caused to occur when the jaw members 28 and 30 are in a spread-apart position whereas, when the pivot pin 52 is selectively repositioned furthest from the pin 42 in opening 68, as shown in the sequence illustrated by the dotted outline in FIG. 4, pawl release may be caused to occur when the handle members 22 and 24 and, consequently, the corresponding jaw members 28 and 30, are in their closest position, as shown by the dotted outline in FIG. 1. To limit the travel of the ratchet member 46 within the housing 32 and to prevent further closure of the handle members 22 and 24 after pawl release has occurred, the ratchet member 46 may be provided with stop means shown as a protuberance 78 located at a fixed distance from the recess 76 in the ratchet member 46 and arranged to abut an adjacent edge 80 of the housing 32 simultaneously with the release of the pawl means 32 as it traverses the entire toothed end portion 44 of the ratchet member 46 and enters the recess 76. It will, of course, be readily apparent to those skilled in the art that other stop means arrangements (not shown) may be provided to serve a similar function, and may include shoulders, detents, or protuberances located within the housing 32 for engagement with abutting elements on the ratchet means 46.

Figure 6:
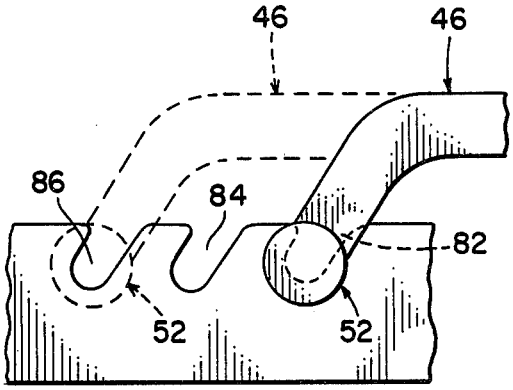
FIGS. 6, 7, and 8 are fragmentary plan views showing further embodiments of a means for selectively repositioning the pivot coupling between a full stroke compelling mechanism and an associated tool handle in accordance with the concepts of the invention.
Figure 7:
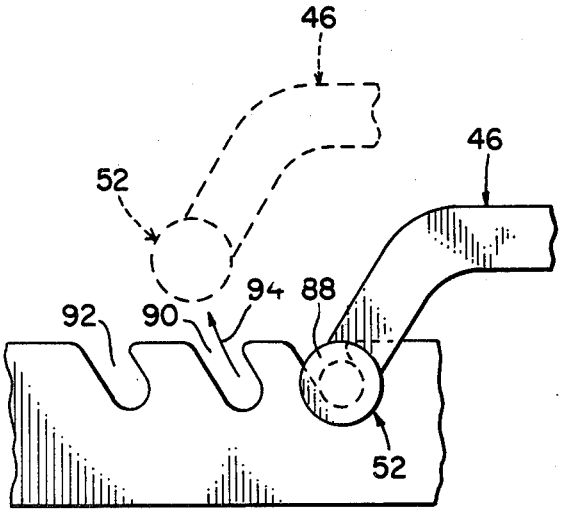
Figure 8:
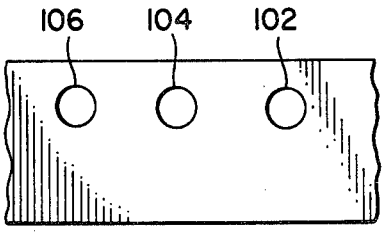

Turning now to FIGS. 6 through 9, there are shown various other embodiments for selectively repositioning the pivot coupling between a full-stroke mechanism and one or both handle members of a tool, in accordance with the concepts of the invention. For example, in FIG. 6 the openings 64, 66, and 68 of handle member 24 are replaced by corresponding inclined slotted portions 82, 84, and 86 for receiving the the pin 52 of ratchet member 46. The dotted outline in FIG. 6 illustrates a repositioning of the ratchet member pin 52 from its position in slotted portion 82 to a second position in slotted portion 86. In FIG. 7 there are shown a series of slotted portions 88, 90, and 92 similar to portions 82, 84, and 86 but inclined in the opposite direction. Thus, whereas in the arrangement shown in FIG. 6 the ratchet member 46 may be moved to the right, as viewed in FIG. 6, to release and reposition the pin 52, in the arrangement shown in FIG. 7 the ratchet member 46 is rotated slightly in the direction shown by the arrow 94 so as to release the pin 52 from the slotted portion 88, as indicated by the dotted outline in FIG. 7. The pin 52 may then be moved to either of the other two slotted portions 90 and 92 in accordance with predetermined directions related to the spacing desired between the jaw members 28 and 30. It should be noted that in the embodiment shown in FIG. 1, the jaw members 28 and 30 of tool 20 are provided with recessed openings arranged in opposing pairs, each pair being designated by the corresponding numerals 96, 96', 98, 98', and 100, 100'. The shape and size of the recessed openings are selectively arranged to accept, for example, a range of connectors or fittings for crimping about one or more conductors (not shown). Since the larger elements in such range will necessarily require less closure of the jaw members 28 and 30, the user may readily reset the tool 30 by moving the pin 52 into the appropriate opening in handle member 24 to insure the desired closure of the jaw members 28 and 30 commensurate with the release of the pawl means 32 from the teeth of the ratchet member 46 so that the handle members 22 and 24 may be re-opened at the completion of the readjusted closure stroke. The details of the operation of such linearly operated full-stroke compelling mechanisms are adequately described in the prior art and need not be repeated here.

Returning now to FIG. 8, a series of totally enclosed apertures 102, 104, and 106 may be substituted for the various openings shown in FIGS. 1 through 7 for receiving the pivot pins 52. In this case, however, the pin 52 must be totally withdrawn from one opening and moved to one of the other openings to reposition the pivot coupling between the ratchet member 46 and the corresponding handle member.

Figure 9:
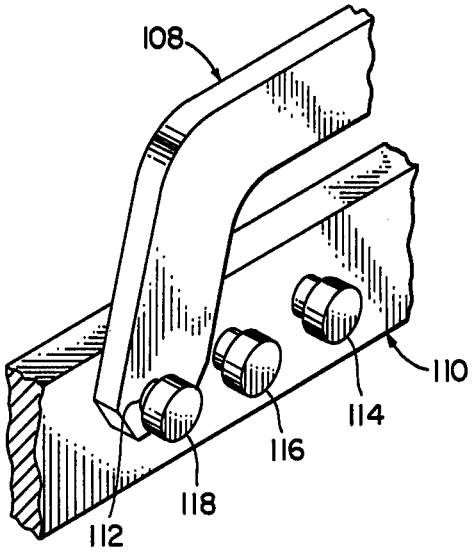
FIG. 9 is a fragmentary perspective view, partly in section, of a further embodiment of a means for selectively repositioning the pivot coupling between a full stroke compelling mechanism and an associated tool handle in accordance with the concepts of the invention.

FIG. 9 shows a further embodiment for repositioning the pivot coupling between a ratchet member 108 of a fullstroke compelling mechanism and a handle member 110 of a tool similar to tool 20 in accordance with the concepts of the invention wherein the ratchet member 108 provided with a notched portion 112 adapted to receive a series of protruding pin elements 114, 116, and 118 which are aligned generally along the longitudinal axis of the handle member 110 in a manner similar to the alignment of the various pin receiving openings illustrated in the embodiments shown in FIGS. 1 through 8. An alternative embodiment similar to that shown in FIG. 9 may be provided simply by enlarging or widening the end portion of ratchet member 108 in the area occupied by the single notched portion 112 and providing therein a series of notched portions (not shown) shown) similar to portion 112 and extending along an axis parallel to the longitudinal axis of handle member 110 and engageable with the pin elements 114, 116, and 118 to extend the range of adjustment. Alternatively, two of the three pin elements 114, 116, and 118 may be removed and a single such pin element provided for engagement with the multiple notched portions of the modified end portion of ratchet member 108.

Figure 10:
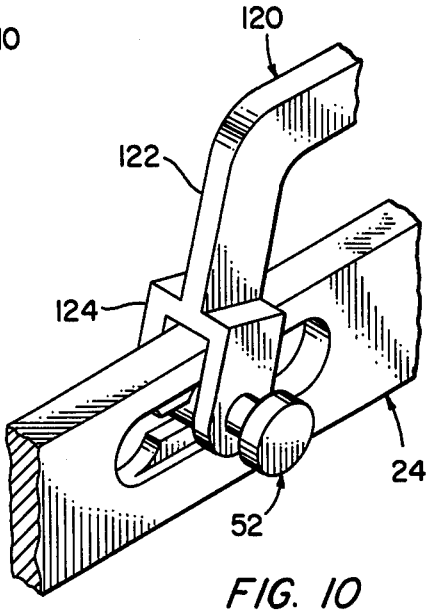
FIG. 10 is a fragmentary perspective view, partly in section, showing a further embodiment of a ratchet means for a tool employing a full stroke compelling mechanism in accordance with the concepts of the invention.

FIG. 10 shows a further embodiment of a portion of a ratchet member 120 constructed in accordance with the concepts of the invention in which its end portion 112 terminates in a generally U-shaped saddle 124 straddling a portion of the handle member 24 and suitably apertured to receive the pin 52 which is of sufficient length to pass through the openings 64, 66, and 68 of the handle members 24 and both leg portions of the saddle 124. This arrangement tends to further stabilize the ratchet member 120 and equalize the force applied to the pin 52 during the closure stroke of the handle members 22 and 24.

Figure 1:
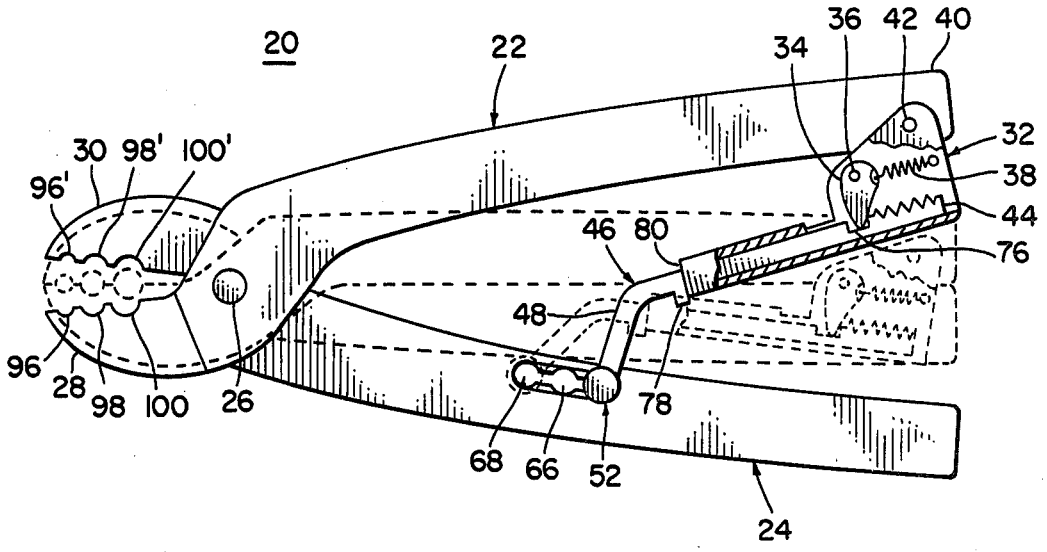
FIG. 1 is a top plan view, partly cut away and partly in section, of a tool employing a full stroke compelling mechanism in accordance with the principles of the invention.
Figure 2:
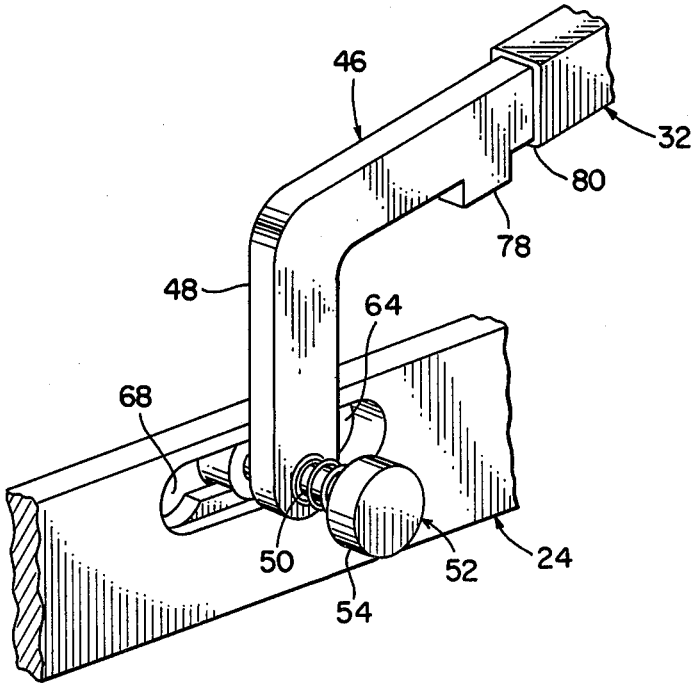
FIG. 2 is a fragmentary enlarged perspective view, partly in section, showing further details of the device of FIG. 1.
Figure 11:
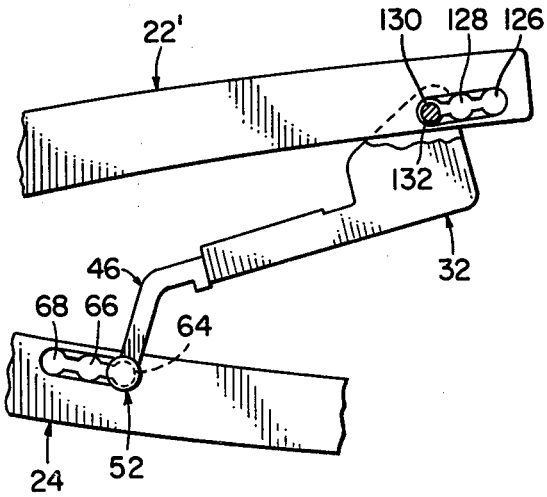
FIG. 11 is a fragmentary plan view, partly cut away and partly in section, of yet a further embodiment of selectively positionable pivot couplings between a full stroke compelling mechanism and the associated handle members of a tool constructed in accordance with the concepts of the invention.

Turning now to FIG. 11 there is shown an embodiment for repositioning the pivot coupling between the housing portion 32 of the full-stroke compelling mechanism and an associated handle member 22′ similar to handle member 22 of a tool such as 20, in accordance with the concepts of the invention. The handle member 22′ is provided with a series of longitudinally aligned openings 64, 66, and 68 in handle member 24 and arranged to receive therein a pivot pin 132 which replaces the housing pivot 42 and is constructed similar to pin 52. The pin 132 may then be repositioned in any one of the openings 126, 128, or 130 in a manner similar to that described above with respect to the repositioning of pin 52 within the openings 64, 66, and 68. By changing the location of the pivot coupling between the housing 32 and the handle member 22′, an adjustment of the point of pawl release may be accomplished in substantially the same manner and with substantially the same effect as that provided by the repositioning of pin 52. Although for most applications one fixed and one movable pivot coupling between the full-stroke compelling mechanism and an associated handle member will be adequate for the purposes herein described, whether the movable pivot coupling be that associated either with the ratchet member or the housing of such mechanism, two movable pivot couplings may be employed in the manner illustrated in FIG. 11, where necessary or desirable, to further increase the range of adjustment available for any particular application. Assuming the openings 64, 66, and 68 located in handle member 24 provide a range of adjustments similar to that shown in FIG. 1, the openings 126, 128, and 130, if employed, should be arranged in such manner that the opening 126 furthest to the right, as viewed in FIG. 1, is located in the handle member 22′ approximately in correspondence with the location of pin 42 in handle member 22. The remaining openings 138 and 130 are therefore correspondingly located, in order, to the left of opening 126, or further inwardly from the end of handle member 22′. This arrangement will thus increase the range of adjustment of the jaw members 28 and 30, relative to the point of pawl release. It may also be found useful to employ the arrangement shown in FIG. 11 where it is desired to provide finer increments of adjustment without unduly increasing the number of openings in either of the handle members. Thus, the spacing between openings 64, 66, and 68 may be reduced to approximately one half the original spacing with a similar spacing provided between openings 126, 128, and 130 so that, although the total range of adjustment will remain substantially the same, the adjustment may be made in finer steps.

It should be understood that although each of the above described embodiments of the invention are shown, for the sake of illustration, as employed with a pivot coupling selectively repositionable within any one of three possible positions, either more or less positions may be provided in substantially the identical manner without departing from the spirit of the invention and within the concepts herein disclosed. It should be further understood that the adaptation of the instant invention to a pliers-like tool as illustrated in FIG. 1 is not intended as a limitation thereof, and that the disclosed arrangements and embodiments may be employed with virtually any two-handled tool to which a linearly operable full-stroke compelling mechanism may be coupled without departing from the spirit of the invention and within the concepts herein disclosed.

The embodiments of the invention in which an exclusive property or privilege is claimed are defined as follows:

1. In a tool of the type having first and second pivotally coupled handle members each coupled to a respective jaw member for applying a compressive force between said jaw members, and including a full-stroke compelling mechanism coupled between said handle members wherein said mechanism includes a housing pivotally coupled to said first handle members, ratchet means coupled to said second handle member and having a toothed end portion linearly movable within said housing, and pawl means in said housing for selective engagement with said toothed end portion of said ratchet means, the improvement comprising: means for selectively repositioning the coupling between said full-stroke compelling mechanism and at least one of said first and said second handle members along the longitudinal axis of said at least one of said first and said second handle members.

2. The improvement as defined in claim 1 wherein said ratchet means further includes stop means cooperative with said housing for limiting the travel of said ratchet means.

3. The improvement as defined in claim 1 wherein said means includes a releasable pivot coupling between said ratchet means and said second handle member.

4. The improvement as defined in claim 3 including pin means on said ratchet means, said second handle member having longitudinally aligned spaced openings selectively engageable with said pin means.

5. The improvement as defined in claim 3 including longitudinally aligned pin means on said second handle member, said ratchet means having an opening selectively engageable with said pin means on said second handle member.

6. The improvement as defined in claim 1 wherein said means includes a releasable pivot coupling between said housing and said second handle member.

7. The improvement as defined in claim 6 including pin means on said housing, said first handle member having longitudinally aligned openings selectively engageable with said pin means on said housing.

8. The improvement as defined in claim 2 wherein said stop means comprises an abutment on said ratchet means fixedly spaced from said toothed end portion of said ratchet means.

9. The improvement as defined in claim 4 further including means for biasing said pin means into engagement with said openings in said second handle member.

10. The improvement as defined in claim 9 wherein said pin means includes a shank portion having an enlarged shoulder portion positionable into and out of engagement with said openings in said second handle member, there being slotted portions interconnecting said openings in said second handle member, said shank portion of said pin means having a further portion of reduced width adjacent said enlarged shoulder portion, said further portion being arranged to slide freely between said openings within said slotted portions.

* * * * *